US005114038A

United States Patent [19]

Laumann geb. Quensen

[11] Patent Number: 5,114,038

[45] Date of Patent: May 19, 1992

[54] TRAY-LIKE CARRIER FOR PLATES AND GLASSES

[75] Inventor: Betina Laumann geb. Quensen, Alfeld, Fed. Rep. of Germany

[73] Assignee: Frauenberger & Co., Isernhagen, Fed. Rep. of Germany

[21] Appl. No.: 524,794

[22] Filed: May 18, 1990

[30] Foreign Application Priority Data

May 18, 1989 [DE] Fed. Rep. of Germany ..... 3916159

[51] Int. Cl.[5] ..... B65D 1/36

[52] U.S. Cl. ..... 220/575; D7/549; 220/23.83

[58] Field of Search ..... D7/549; 206/541, 217, 206/562; 220/23.83, 23.86, 574, 575

[56] References Cited

U.S. PATENT DOCUMENTS

| | | | |
|---|---|---|---|
| D. 115,730 | 7/1939 | Brandes et al. | D7/549 |
| D. 147,543 | 9/1947 | Farmer | D7/549 |
| D. 194,114 | 11/1962 | Graham | D7/549 |
| D. 308,461 | 6/1990 | Hosea | D7/549 |
| 2,107,023 | 2/1938 | Bertsch | 220/23.8 |
| 4,232,789 | 11/1980 | Springer | 220/23.8 |
| 4,461,396 | 7/1984 | Harper | 220/23.83 |
| 4,516,785 | 5/1985 | French | 220/23.83 |
| 4,607,758 | 8/1986 | Stevens | 220/23.83 |
| 4,732,274 | 3/1988 | Bouton | 220/23.83 |
| 4,961,555 | 10/1990 | Egan, Jr. | 220/23.83 |

FOREIGN PATENT DOCUMENTS

| | | | |
|---|---|---|---|
| 2297023 | 8/1976 | France | 220/23.83 |
| 2615086 | 5/1987 | France . | |
| 248226 | 3/1926 | United Kingdom . | |
| 2078095 | 1/1982 | United Kingdom | D7/549 |
| 2078493 | 1/1982 | United Kingdom | 220/23.83 |
| 2154428A | 9/1985 | United Kingdom . | |

*Primary Examiner*—Jimmy G. Foster
*Attorney, Agent, or Firm*—Shlesinger, Arkwright & Garvey

[57] ABSTRACT

A tray-like carrier for plates and glasses essentially consists of a plane, rigid platform. Several clearances or recesses allow receiving a plate and where called for a stemmed drinking glass. A grip clearance allows holding and transporting the carrier with one hand.

17 Claims, 1 Drawing Sheet

FIG.1
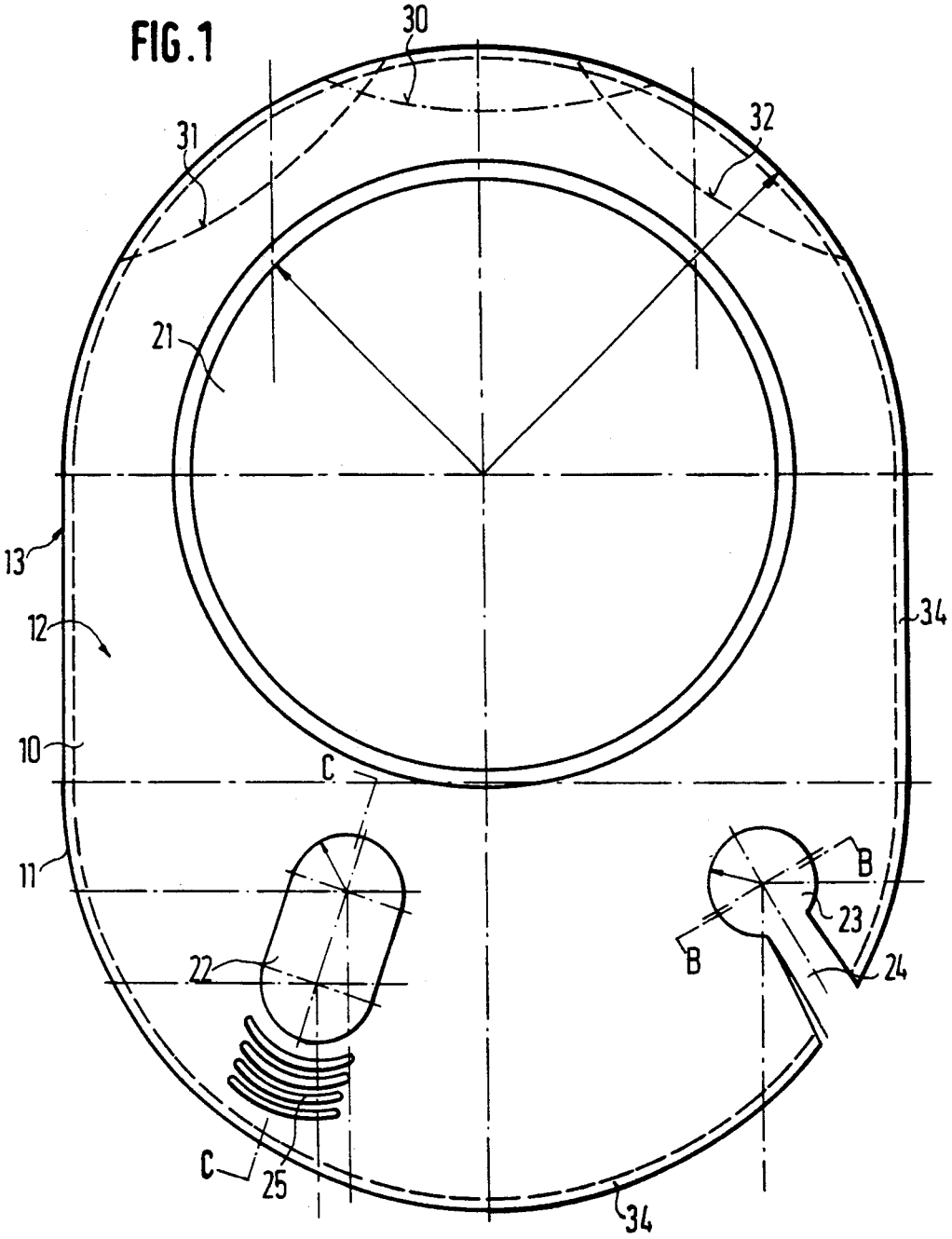
FIG.4
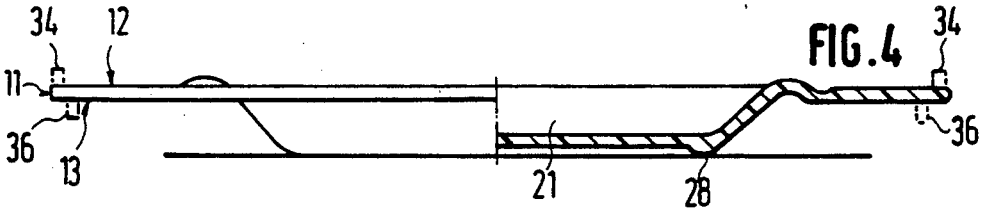
C-C
FIG.3
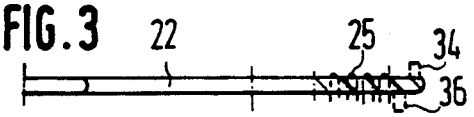
B-B
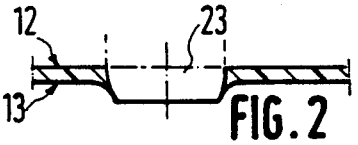
FIG.2

TRAY-LIKE CARRIER FOR PLATES AND GLASSES

The invention concerns a tray-like carrier for [food] plates and glasses with an essentially plane, rigid platform.

Trays are used to carry dishes, for instance from the kitchen to the dinner table. They also may be used at parties to offer food and beverages.

Once the guest has helped himself to food and beverages and wishes to consume them while standing, another problem arises however. He needs both hands to hold the platform—which frequently consists of flexible cardboard—and can consume the food only carefully. More difficulties arise if, in the typical case, he is carrying a conversation with another guest.

The object of the invention is to create a tray-like carrier for plates and glasses that also will allow problem-free food consumption while standing.

This problem is solved for a carrier of the invention in that provision is made for a recess or clearance to secure in slip-proof manner a platform and further for a grip-clearance, which in topview is oblong-round through which to pass the user's thumb so he can grip the carrier and hold it with one hand.

This tray-like carrier easily makes it possible to consume food while standing. Illustratively the party guest seizes the platform, moves the thumb through the grip clearance, puts the front thumb phalanx on the top side of the platform-shaped body and supports the underside with the back of the thumb or of the had. As a result the platform-shaped, rigid body is held in very stable manner and can be easily counterbalanced by the guest. Next plates, for instance with cold buffet food, can be deposited on the carrier. One plate is placed in the first clearance wherein it is secured in stable manner. The guest's second hand remains free and may be used to ingest the food by means of a fork or spoon. Food and beverages may be taken along to change locations, also another room may be entered. Conversation can take place unhampered, without having to put down the tray or, in the previous manner, without having to forcefully grip a cardboard platform at its rim. Simultaneously the tray-like carrier allows placing the cutlery on the platform when not needed.

The recess also may be integrated into the platform in the form of a plate. In this case no separate plate is deposited, instead the food is deposited on said integrated plate. This is a possibility for plastic, disposable dishes. In this case the plate is molded jointly as a fixed component together with the platform.

Where separate plates are concerned, it is possible furthermore to manufacture such plates illustratively made of ceramic or china and matching the carrier and to offer this carrier together with the said plates as a set.

The posture of the carrier's user is unstressed because the center of gravity of the carrier is advantageously adjusted by this user himself and can be vertically supported by the entire forearm length. This stands in contrast to conventional trays which are supported on horizontally stretched arms.

Accordingly the invention offers holding by the arm which is more reliable, more comfortable and also more variable. In spite of the weight, the arms shall not tire.

The advantages of the invention are especially marked when there are a slot starting at the rim and an adjoining circular aperture to receive the cup of a stemmed drinking glass, the slot serving to introduce the stem when laterally inserting the drinking glass into the aperture.

Hence a drinking glass with stem, in particular a wine or champaign glass and where called for a brandy glass or the like may now be inserted in addition to the plate. The filled glass with the contents (the cup) now is secured in slip-proof manner on the upper side of the platform, whereas the stem projects from the underside, thereby making possible selective food serving or drinking from the glass. Now as before only one hand is required to hold the tray-like carrier, and therefore the second hand remains totally free. Heretofore a standing guest could either hold a plate with one hand and manipulate a fork or spoon with the other. Then the drinking glass had to be put down; or else the guest would hold a drinking glass, in which case food ingestion was impossible.

Moreover the invention prevents that by holding the glass in the hand for a fairly long time, the drink would be undesirably warmed as was the case heretofore. The glass need not be deposited separately, being often forgotten then in practice.

Appropriately this part of the platform is designed in such a manner that the clearance diameter exceeds the slot width. As a result the drinking glass is secured in particular against undesired slippage to the outside: it requires being lifted somewhat when it must be removed.

Moreover the cross-sectionally circular clearance may conically flare from the lower side to the top side. This flaring may match the shape of the glass.

Seen in topview, the carrier assumes approximately the shape of a painter's palette such as are used by artists to mix and use the paints while they are working.

In an esthetic design, the platform-like body assumes an approximately oval contour. Thereby various clearances can be spread over the oval uniformly and compactly. Whereas the clearance for the plate ordinarily shall be circular and shall claim most of the available space on the top side of the platform-shaped body and does define centrally the one side of the oval, the smaller clearances for the grip and the drinking glass are present on the other side.

At the same time, this compactness assures high economy of material for the platform-like carrier of which the weight thereby is also lowered.

If the contour of the grip clearance is oval, it will be especially easy to pass the human thumb through it on one hand and on the other to rest the front thumb link on the top side, while the thumb or the back of the hand supports the lower side.

Firm gripping is enhanced by flutings being present on the top side of the platform-like body near the grip aperture. These flutings may be skin-compatible to avert forming sweat beads.

In an especially preferred design, the flutings run parallel to the contour edge of the grip clearance. Thereby thumb slippage is prevented very effectively. If the contour of the grip clearance is oval, the flutings will extend in an approximate half circle along one side of the oval.

The tray-like carrier means will be used in large numbers at a party. Appropriately therefore they shall be stackable, on one hand prior to being used and during storage, and on the other hand following use prior to possible cleaning. In order to easily separate the carriers, advantageously at least three mutually distant spacer means 28 shall be provided at the lower side of the platform-like body. As a result it will be easy to enter the spaces between the individual platforms of the particular tray-like carriers and to remove the uppermost one.

Very advantageously the platform-like body shall be a washable plastic for purposes of cleaning. Alternatively however the body also may be made of an enameled metal. In both cases the carrier can be made esthetic, easy to clean and durable.

An illustrative embodiment of the invention is described in detail below in relation to the drawings.

FIG. 1 is a topview of the tray-like carrier of the invention,

FIG. 2 is a section along the line B—B of FIG. 1,

FIG. 3 is a section along line C—C of FIG. 1 and

FIG. 4 is a sideview of the carrier of FIG. 1 shown in partial section.

Essentially the tray-like carrier consists of a plane, platform-like rigid body, a platform 10 of oval contour, a rim 11, a top side 12 facing the observer in FIG. 1, and a lower side 13.

The illustrative embodiment of FIG. 1 comprises three clearances. A first circular clearance or recess 21 takes up the largest part of the one side of the oval body. The center of the circular recess 21 is midway between the two longitudinal sides of the rim 11 and next to one of the short sides of the oval.

A second clearance is the grip aperture 22. This aperture evinces an oblong-round contour, i.e. it is an oval. It extends from the top side 12 to the lower side 13 of the platform-like body 10, as shown in FIG. 3. The contour is rounded because of the user's thumb being inserted into this grip aperture 22. The width of the grip clearance 22 therefore matches that of the human thumb. The length is such that the thumb may rest on the top side 12 of the body 10. Flutings 25 are present in this area and run parallel to the contour of the grip aperture 22, assuring improved slip-resistance of the thumb on the top side 12. The back of the hand of the user can rest on the lower side 13 of the body 10—namely to the left and to the right of the clearance 22 and also between the clearance 22 and the recess 21.

As shown best of all by FIG. 4, the recess 21 of the illustrative embodiment may be sealed at the bottom whereas the clearance 22 passes through. However the recess 21 may be replaced by a through-clearance which in that event shall set a limit on the size of the plates which may be inserted.

A third clearance 23 is circular in cross-section and like the clearance 22 is present on that side of the oval platform 10 which is away from the recess 21. The circular cross-section of the clearance 23 flares conically from the lower side 13 toward the upper side 12 of the platform 10—see FIG. 2—in order to receive a inversely conical drinking glass and to support it well. This stemmed drinking glass can be inserted sideways through a slot 24 into the clearance 23. The slot 24 joins the clearance 23 to the rim 11 of the platform 10. The width of the slot 24 exceeds the diameter of the drinking glass stem.

The front shape of the platform 10 is formed by two semi-circles at the narrow sides. The circular recess 21 is concentric with one of the semi-circles. The center of the second semi-circle is located approximately at the rim of the circular recess 21 that is away from the first semi-circle.

The rim of the recess 21 may be flanged upward to better secure and support a plate. To improve the stackability and stability when in the stored position, the lower side of the recess 21 may be provided with a circumferential downward projecting lip near the rim (FIG. 4).

The material of the platform-like body may be a washable plastic or also enameled metal. In especially simple embodiments, cardboard or a disposable material also may be applicable.

To be particularly esthetic, the platform 10 may be metallized, for instance being chromed, silvered or gilded.

In order that the platform 10 can be freely handled for the purpose of the invention also with persons of comparatively short arms, a central or slightly off-center or two laterally offset rim clearances 30, 31, 32 for the elbow-inside are present on that side opposite the grip clearance 22, in the manner indicated by the dashed lines in FIG. 1.

The carrier platform 10 may be provided with an at least partially peripheral stacking rim 34, 36 at the upper and lower sides, the lower stacking rim 36 being inwardly offset by about the thickness of the upper stacking rim. The stacking rims are shown by dashed lines in FIGS. 1, 3 and 4. As a result, a number of platforms can be securely stacked onto each other.

I claim:

1. A tray-like carrier for plates and glasses, with an essentially plane, rigid platform, characterized in that recess means (21) is present to receive a plate is slip-proof manner and further a grip clearance (22) which is oblong-round when seen in top view and serving to pass the user's thumb for gripping and one-hand transporting of the carrier, flutings (25) are present on the top side (12) of the platform (10) near the grip clearance (22), said flutings (25) run parallel to the contour rim of the grip clearance (22).

2. Carrier defined in either of claims 1, characterized in that a slot (24) starting at the rim (11) and an adjoining circular clearance (23) to receive the cup-part of a stemmed drinking glass are present, the slot (24) being dimensioned to guide the stem when the drinking glass is laterally inserted into the clearance (23).

3. Carrier defined in claim 2, characterized in that the diameter of the clearance (23) exceeds the width of the slot (24).

4. Carrier defined in claim 2, characterized in that the cross-sectionally circular clearance (23) conically flares from the lower side (13) to the top side (12) of the platform (10).

5. Carrier defined in claim 2, characterized in that the grip clearance (22) and/or the clearance (23) with slot (24) are present near the rim at one end of the carrier (10).

6. Carrier defined in claim 1, characterized in that the grip clearance (22) has an oval contour.

7. Carrier defined in claim 1, characterized in that the lower side (13) of the platform (10) is provided with spacer projections (28) at three or more mutually distant sites.

8. Carrier defined in claim 1, characterized in that the clearance (21) serving to receive a plate in slip-proof manner comprises a downward projecting rim at its lower side.

9. Carrier defined in claim 1, characterized in that the contour of the platform (10) is oval.

10. Carrier defined in claim 1, characterized in that the platform (10) is made of a washable plastic, metal, wood, porcelain or ceramic.

11. Carrier defined in claim 1, characterized in that the panel (10) is made of an enameled metal.

12. Carrier defined in claim 1, characterized in that the platform (10) is metallized.

13. Carrier defined in claim 1, characterized in that a central rim clearance or a clearance slightly off center or two laterally offset arcuate rim clearances (30, 31, 32) for the elbow inside are present on that side which is opposite the grip clearance (22).

14. Carrier defined in claim 1, characterized in that the carrier comprises an at least partly peripheral stacking rim (34, 36) at the top and at the lower sides.

15. Carrier defined in claim 14, characterized in that the lower stacking rim (36) is inwardly offset relative to the upper stacking rim (34) by approximately the thickness of said upper stacking rim.

16. A tray-like carrier for plates and glasses, comprising:

a) an essentially plane, rigid platform;

b) recess means (21) for receiving a plate in slip-proof manner;

c) grip clearance (22) which is oblong-round when seen in top view and serving to pass the user's thumb for gripping and one-hand transporting of the carrier;

d) flutings (25) being formed on the top side (12) of the platform near the grip clearance (22), said flutings (25) run parallel to the contour of the grip clearance (22); and, e) a slot (24) starting at a rim (11) and adjoining circular clearance (23) to receive the cup-part of a stemmed drinking glass.

17. A tray-like carrier for plates and glasses, comprising:

a) an essentially plane, rigid platform;

b) a grip clearance (22) which is oblong-round when seen in top view and serving to pass the user's thumb for gripping and one-hand transporting of the carrier; and, c) elbow abutment means for abutting an elbow of the user holding the carrier, said elbow abutment means being operably associated with said grip clearance.

* * * * *